United States Patent [19]

Ghering

[11] Patent Number: 4,962,557

[45] Date of Patent: Oct. 16, 1990

[54] DEVICE FOR OPENING INNER AND OUTER PONTOONS OF A W-SHAPED, UNFOLDABLE PONTOON UNIT CONSISTING OF TWO INNER PONTOONS AND TWO OUTER PONTOONS

[75] Inventor: Jan Ghering, Ginsheim-Gustvsburg, Fed. Rep. of Germany

[73] Assignee: MAN Gutehoffnungshütte, Oberhausen, Fed. Rep. of Germany

[21] Appl. No.: 478,267

[22] Filed: Feb. 9, 1990

[30] Foreign Application Priority Data

Feb. 21, 1989 [DE] Fed. Rep. of Germany ..... 3905283

[51] Int. Cl.[5] ..... E01D 15/08; E01D 15/14

[52] U.S. Cl. ..... 14/27; 114/29

[58] Field of Search ..... 13/1, 2.6, 27; 114/29

[56] References Cited

U.S. PATENT DOCUMENTS

| | | | |
|---|---|---|---|
| 3,651,528 | 3/1972 | Behrmann et al. | 14/27 |
| 3,946,686 | 3/1976 | Van der Werff | 114/29 |
| 4,223,623 | 9/1980 | Brunet et al. | 14/27 |
| 4,386,441 | 6/1983 | Lundholm | 14/2.6 |
| 4,411,037 | 11/1983 | Terrien et al. | 14/27 |
| 4,413,369 | 11/1983 | Terrien et al. | 14/2.6 |
| 4,493,284 | 1/1985 | Echtler | 14/27 |
| 4,561,376 | 12/1985 | Fitzgerald-Smith | 14/27 |
| 4,730,574 | 3/1988 | Diefendahl et al. | 14/27 |
| 4,833,750 | 5/1989 | Gherling | 14/27 |

FOREIGN PATENT DOCUMENTS

| | | | |
|---|---|---|---|
| 2414359 | 10/1974 | Fed. Rep. of Germany | 114/29 |
| 3424454 | 1/1986 | Fed. Rep. of Germany | 114/29 |
| 56-79082 | 6/1981 | Japan | 114/29 |
| 56-79083 | 6/1981 | Japan | 114/29 |
| 1127802 | 12/1984 | U.S.S.R. | 114/29 |

*Primary Examiner*—Stephen J. Novosad
*Assistant Examiner*—Gay Ann Spahn
*Attorney, Agent, or Firm*—McGlew and Tuttle

[57] ABSTRACT

A device for opening a pontoon unit to form a pontoon bridge, in which two inner pontoons and two outer pontoons are connected by hinges such that they can be opened in the shape of a W. In the collapsed state, the two inner pontoons are connected to an upper middle hinge and the two outer pontoons are joined to the adjoining inner pontoons by a lower hinge each. The lower hinge is formed by two pins which are arranged in the adjoining corners of the inner pontoon and outer pontoon. The pins are pivotably connected by a projecting lever, and the freedom of movement of the projecting end of the lever can be limited by stops. The end of the lever facing the outer pontoon is attached to a tension spring. The outer pontoons are opened by the tensioned tension springs against the buoyancy acting on them.

According to the present invention, a swiveling rocker arm (7) with a stop (8) is arranged at the end of the part (3*b*) of lever (3) projecting toward the outer pontoon (2), and the tension spring (9) is attached at the end of the rocker arm (7). In the collapsed state of the inner pontoon (1) and the outer pontoon (2), and with the tension spring (9) tensioned, stop (8) comes into contact with the end of the projecting part (3*b*) of lever (3). Rocker arm (7) forms an extended lever arm of lever (3). In the opened state of the inner pontoon (1) and the outer pontoon (2) and with the tension spring (9) released, the rocker arm (7) forms an angle with the projecting part (3*b*) of lever (3).

6 Claims, 1 Drawing Sheet

DEVICE FOR OPENING INNER AND OUTER PONTOONS OF A W-SHAPED, UNFOLDABLE PONTOON UNIT CONSISTING OF TWO INNER PONTOONS AND TWO OUTER PONTOONS

FIELD AND BACKGROUND OF THE INVENTION

The present invention relates in general to devices for opening the inner pontoon and the outer pontoon of a pontoon unit consisting of two inner pontoons and two outer pontoons. The arrangement opens into the shape of a W such that the outer pontoons are attached to the adjoining inner pontoons pivoted on hinges. The hinges are formed by two pins, each pin arranged in the adjoining corners of the inner pontoon and the outer pontoon. They are connected by a lever pivoted about the pins. The lever has parts projecting over the pins and extending in the longitudinal direction of the lever. A tensioning spring is attached to the outer pontoon and acts on the end of part of the lever which end faces the outer pontoon. The lever is located in a free space below the pontoon deck of the inner pontoon and in a free space under the pontoon deck of the outer pontoon in the open state of the inner pontoon and the outer pontoon. The movement of the inner pontoon and the outer pontoon in the opened and collapsed states is limited by stops provided on the inner pontoon and the outer pontoon, the stops acting on the lever.

West German Preliminary Published Patent Application No. 34,06,392 discloses a device of the same class for opening a pontoon unit for forming a pontoon bridge, in which two inner pontoons and two outer pontoons are connected with hinges such that they can be opened in a W-shaped pattern and in the collapsed state, the two inner pontoons are connected to a top middle hinge and the two outer pontoons are joined to the adjoining inner pontoons by a lower hinge each. The lower hinge is formed by two pins which are arranged in the adjoining corners of the inner pontoon and outer pontoon. The pins are connected pivotably by a projecting lever, and the freedom of movement of the projecting ends of the lever can be limited by stops. The end of the lever facing the outer pontoon is connected to a tension spring.

The outer pontoons of the W-shaped collapsible pontoon unit are opened by the tensioned tension springs against the bouyancy acting on them, so that no special help is needed for opening.

According to West German Patent Specification No. 35,40,607, the pontoon unit can be collapsed without using additional devices in the form of push boats or the like and without excessive effort, in that a joining piece of variable length is inserted between a free end of the tension spring and a connection point on the outer pontoon. The joining piece can be designed as a hydraulic piston-cylinder unit, in which the piston or the cylinder is connected to the free end of the spring and the cylinder or the piston is connected to the outer pontoon, respectively.

In the prior-art designs, a free space is needed in the area of the lever under the deck of the pontoon, and this free space inherently weakens locally a projecting pontoon deck structure. The length of the projecting part of the lever on the side of the outer pontoon of the prior-art designs and consequently also the longitudinal dimension of the free space needed under the pontoon deck are also determined by the maximum allowable dimension of the tension spring.

SUMMARY AND OBJECTS OF THE INVENTION

The task of the present invention is to improve a device of this class such that the length of the free space under the pontoon deck of the outer pontoon can be made as short as possible in order to minimize the weakening of the deck structure without any need to change other design parameters of the prior-art design, such as the maximum dimension of the tension spring and the overhang of the pontoon deck, and a weaker tension spring force and consequently a lighter-weight construction of the device are also desirable.

According to the invention, a swiveling rocker arm with a stop is arranged at the end of the end part of the lever. This stop projects toward the outer pontoon and the tension spring and is fastened at the end of the rocker arm. In the collapsed state of the inner pontoon and the outer pontoon and with the tension spring tension, the stop comes into contact with the end of the projecting part or end part of the lever and the rocker arm forms an extended lever arm of the lever. In the opened state of the inner pontoon and the outer pontoon and with the tension spring released, the rocker arm is folded down to form an angle with the projecting part or end part of the lever.

Advantageous embodiments of the present invention are specified in the subclaims.

Thus, the lever has only a short projecting part on the side of the outer pontoon. The free space under the pontoon deck can consequently be made shorter than in the prior-art design. In the opened state of the pontoon unit, this free space is only slightly longer than the projecting part of the lever. The "extension" of the projecting part, i.e., the rocker arm, now lies outside the free space, enclosing an angle with the lever.

Thus, it is achieved with the device that the length of the free space under the pontoon deck can be made shorter, which makes it possible to better stiffen the pontoon deck in the case of a projecting pontoon deck structure, so that heavier loads can be supported by the projecting pontoon deck.

The swiveling rocker arm arranged at the end of the lever, with the prior-art tension spring attached to the end of said rocker arm, has a milled stop, with which said rocker arm lies on the projecting part of the lever in the collapsed state of the pontoon unit, thus forming a longer lever arm. The force of the tension spring now acts on this longer lever arm. This means that in the device according to the present invention, the required force of the tension spring is weaker than in the prior-art devices, and the spring tensioning device can therefore be of a lighter design.

The longer lever arm on the side of the outer pontoon also offers the possibility of arranging the end stop for the lever on the pontoon side wall farther away from the fulcrum point of the lever, as a result of which the contact pressure is reduced.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figure 1:
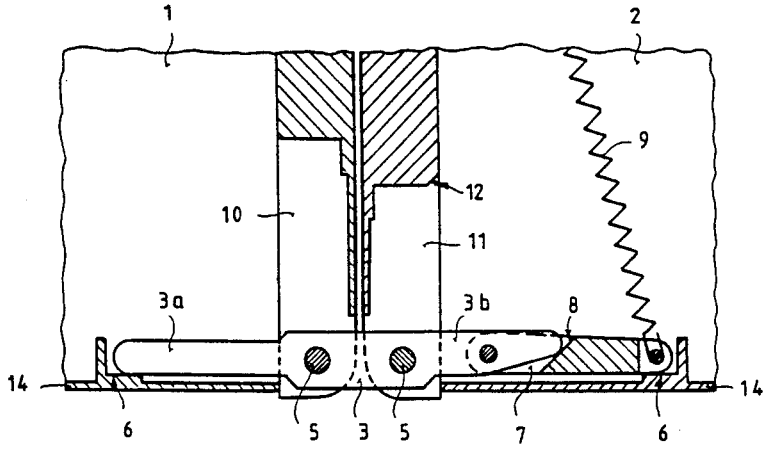
FIG. 1 is a schematic view showing a detail of the hinged connection between the inner pontoon and the outer pontoon of a pontoon unit in the collapsed state: and, FIG. 2 is a schematic view showing a corresponding detail of the pontoon unit in the opened state.

All the elements that are not essential for the understanding of the device have been omitted in the drawings. The principle of the W-shaped opening and collapsing of a pontoon unit is sufficiently well known from the documents mentioned in the introduction.

The representation according to FIG. 1 shows details of an inner pontoon 1 and an outer pontoon 2, which is hinged to the inner pontoon 1, in a pontoon unit consisting of two inner pontoons and two outer pontoons for a pontoon bridge, in the collapsed state. As was mentioned above, the complete pontoon unit is not shown. It should only be mentioned that a middle hinge, which connects the inner pontoon of a pontoon unit, is arranged at the upper end (not shown) of the inner pontoon.

Lever 3 of the hinge is formed with two pins 5 and connects the inner pontoon 1 and the outer pontoon 2. In the collapsed state of the pontoons 1, 2, at the lower end the lever 3 abuts against the pontoon side walls 14 between the two stops 6.

The projecting part **3*b* of lever 3 has at its end a swiveling rocker arm 7. The rocker arm 7 has a stop 8 which strikes the end of the projecting part 3*b* of the lever 3 and thus forms an extended lever arm in the collapsed state of the pontoon unit (according to FIG. 1**).

The tension spring 9 arranged on said rocker arm 7 is tensioned in the collapsed state of the pontoon unit.

Figure 2:
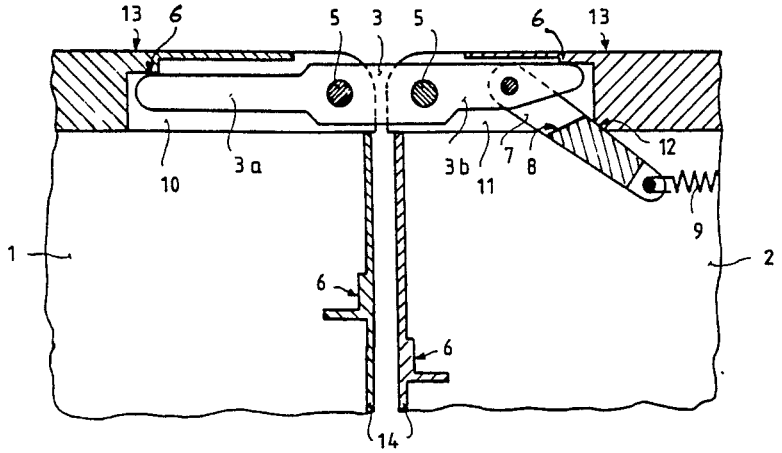

FIG. 2 shows details of the inner pontoon 1 and the outer pontoon 2 in the opened state of the pontoon unit. The lever 3 with its projecting parts **3*a*, 3*b* is located within the free spaces 10, 11 under the pontoon deck 13. The relatively short projecting part 3*b* is depicted in the correspondingly short free space 11. The sum of the lengths of the free spaces 10, 11 is also only slightly greater than the overall length of lever 3, i.e., the length of said free space 11 of said outer pontoon 2 is substantially shorter than in the prior-art design. In the opened state of the pontoon unit, the rocker arm 7 is located at the angled limit portion 12 of said free space 11, forming an angle with said projecting part 3*b* of said lever 3**.

The tension spring 9 arranged on said rocker arm 7 is released in the opened state of the pontoon unit.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

What is claimed is:

1. A device for opening a pontoon arrangement including a first pontoon structure having an inner pontoon and an outer pontoon and a second pontoon structure having an inner pontoon and an outer pontoon, said pontoon arrangement being openable in the shape of a W, an outer pontoon of the first pontoon structure being attached to the adjoining inner pontoon of the second pontoon structure at a corner of the first inner pontoon and the second outer pontoon, comprising:

a free space provided in a structural element below a pontoon deck of the first inner pontoon; a free space formed in a structural member below a pontoon deck of the second outer pontoon, said inner pontoon free space and said second outer pontoon free space being defined at an adjoining corner of said first and second pontoon structure; a first pin connected to said first inner pontoon at said first inner pontoon adjoining corner; a second pin connected to said second outer pontoon at said second outer pontoon adjoining corner; a lever connected to each of said first and second pins for pivotal movement about said pins, said lever including a first lever part extending under said first inner pontoon and a second lever part extending under said second outer pontoon, said second lever part being connected to a pivot pin engaging a swivelling rocker arm, said swivelling rocker arm including a stop; a tension spring fastened at an end of the rocker arm and fastened to said second pontoon unit for maintaining the spring tensioned in a collapsed state of the inner pontoon and the outer pontoon wherein said stop comes into contact with the end of said projecting part of said lever and said rocker arm forming an extended lever, and in said open state of said inner pontoon and said outer pontoon said tension spring is released, said rocker arm being folded down to form an angle with the projecting part of said lever.

2. A device according to claim 1, wherein in the open state of the inner pontoon and the outer pontoon, the rocker arm is fixed in an angular position by a limit portion defined adjacent said free space under the pontoon deck of the outer pontoon, said limit portion acting as a stop.

3. A device according to claim 1, wherein the combined length of the first and second free space under the pontoon decks, is only slightly greater than the overall length of said lever.

4. Device for opening an inner pontoon (1) and an outer pontoon (2) of a pontoon unit including of two inner pontoons (1) and two outer pontoons (2), which can be opened in the shape of a W, whose outer pontoons (2) are attached to the adjoining inner pontoons (1) pivoted in hinges, wherein the hinges are formed by two pins (5) each arranged in the adjoining corners of the inner pontoon (1) and the outer pontoon (2) and are connected by a lever (3) pivoted about the pins (5) and said lever (3) has parts (**3*a*, 3*b*) projecting over the pins (5) and extending in the longitudinal direction of lever (3), and a tension spring (9) attached to the outer pontoon (2) acts on the end of part (3*b*) of lever (3), which end faces the outer pontoon (2), and said lever (3) is located in a free space (10) below the pontoon deck (13) of the inner pontoon (1) and in a free space (11) under the pontoon deck (13) of the outer pontoon (2) in the opened state of the inner pontoon (1) and outer pontoon (2), and the movement of the inner pontoon (1) and the outer pontoon (2) in the opened and collapsed states is limited by stops (6) provided on the inner pontoon (1) and the outer pontoon (2), which stops act on the lever (3), comprising: a swiveling rocker arm (7) with a stop (8) arranged at the end of one of said lever parts (3*b***)

projecting toward the outer pontoon (2) and the tension spring (9) is fastened at the end of the rocker arm (7), and in the collapsed state of the inner pontoon (1) and the outer pontoon (2) and with the tension spring (9) tensioned, said stop (8) comes into contact with the end of one of said lever parts (3*b*) of said lever (3) and said rocker arm (7) forms an extended lever arm of said lever (3), while in the opened state of the inner pontoon (1) and the outer pontoon (2) and with tension spring (9) released, said rocker arm (7) is folded down to form an angle with the projecting part (3*b*) of said lever (3).

5. Device in accordance with claim 1, wherein in the opened state of the inner pontoon (1) and the outer pontoon (2), said rocker arm (7) is fixed in an angular position by a limitation (12) of the free space (11) under the pontoon deck (13) of the outer pontoon (2), which limitation acts as a stop.

6. Device in accordance with claim 1, wherein the sum of the lengths of the free spaces (10, 11) under the pontoon decks (13), which receive said lever (3), is only slightly greater than the overall length of said lever (3).

* * * * *